US008733804B1

(12) United States Patent
Park et al.

(10) Patent No.: US 8,733,804 B1
(45) Date of Patent: May 27, 2014

(54) INTERRUPT STRUCTURE OF POWER LATCH

(71) Applicant: Hyundai Motor Company, Seoul (KR)

(72) Inventors: Hoo Sang Park, Hwaseong-si (KR); Sang Hoon Gweon, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/768,562

(22) Filed: Feb. 15, 2013

(30) Foreign Application Priority Data

Nov. 8, 2012 (KR) ..... 10-2012-0125973

(51) Int. Cl.
*E05C 3/06* (2006.01)

(52) U.S. Cl.
USPC ..... 292/199; 292/216; 292/201

(58) Field of Classification Search
USPC ..... 292/199, 216, 201, DIG. 23
See application file for complete search history.

(56) References Cited

U.S. PATENT DOCUMENTS

| | | | | |
|---|---|---|---|---|
| 5,649,130 | A * | 7/1997 | Nakajima et al. | 399/327 |
| 5,918,917 | A * | 7/1999 | Elton et al. | 292/201 |
| 6,053,542 | A * | 4/2000 | Ostrowski et al. | 292/201 |
| 6,550,825 | B2 * | 4/2003 | Ostrowski et al. | 292/199 |
| 6,676,556 | B2 * | 1/2004 | Ishihara et al. | 475/269 |
| 7,175,212 | B2 * | 2/2007 | Cetnar et al. | 292/216 |
| 7,823,936 | B2 * | 11/2010 | Compeau | 292/201 |
| 2008/0224482 | A1 * | 9/2008 | Cumbo et al. | 292/216 |
| 2009/0230700 | A1 | 9/2009 | Arabia et al. | |
| 2012/0299313 | A1 * | 11/2012 | Organek et al. | 292/129 |

FOREIGN PATENT DOCUMENTS

| | | | |
|---|---|---|---|
| KR | U1998-051925 | | 10/1998 |
| KR | 10-0705132 | B1 | 4/2007 |
| KR | 10-0853908 | B1 | 8/2008 |
| KR | 10-2010-0077163 | A | 7/2010 |
| KR | 10-1022207 | B1 | 3/2011 |

* cited by examiner

*Primary Examiner* — Mark Williams
(74) *Attorney, Agent, or Firm* — Morgan, Lewis & Bockius LLP

(57) ABSTRACT

An interrupt structure of a power latch includes a cinching lever enabling automatic latching, a detecting lever having one end rotatably mounted at the cinching lever and the other end including an outer wall having gear teeth formed on an inner peripheral surface thereof, a gear part engaged with the gear teeth formed on the outer wall of the detecting lever, and a detecting auxiliary lever rotatably mounted at the other end of the detecting lever and having one end engaged with the gear part and the other end protruded outwardly. Therefore, the detecting lever is operated in an opposite direction to an operation direction according to the related art to prevent generation of interference with the cinching lever, thereby making it possible to decrease noise. In addition, rigidity of a detecting lever avoidance section formed at the cinching lever is reinforced, thereby making it possible to improve durability.

4 Claims, 4 Drawing Sheets

(a) (b)

INTERRUPT STRUCTURE OF POWER LATCH

CROSS-REFERENCE TO RELATED APPLICATION

The present application claims priority of Korean Patent Application Number 10-2012-0125973 filed Nov. 8, 2012, the entire contents of which application is incorporated herein for all purposes by this reference.

BACKGROUND OF INVENTION

1. Field of Invention

The present invention relates to an interrupt structure of a power latch, and more particularly, to an interrupt structure of a power latch for improving interrupt durability of the power latch and decreasing noise generated at the time of an operation.

2. Description of Related Art

Generally, in a vehicle, when a passenger does not completely close a door, a warning lamp is turned on to warn a driver that the door is not appropriately closed. In this case, in order to turn off the warning lamp, the passenger should again open and then close the door, which is inconvenient.

A power closing function, which is a function mainly applied to a side door of a luxury vehicle in order to solve this convenience, is a function of completely latching the side door by forcibly latching the side door using a motor when the passenger does not strongly close the side door.

That is, when the side door is not two-stage latched, but is one-stage latched, a power closing actuator operates the motor to forcibly rotate and two-stage latches a lever, such that the side door is completely latched.

Meanwhile, recently, a power latch function of two-stage latching the latch by force of the motor at the time of one-stage latching the latch as described above has been applied. In addition, in the power latch, a cinching operation is possible. When a user operates a handle in order to open the door during automatic latching, an automatic latching function is canceled, such that an interrupt function of enabling opening of the door is possible.

However, in an interrupt structure of a power latch according to the related art, as shown in FIGS. 1(*a*) and 1(*b*), at the time of an operation, a cancelling lever operates a detecting lever to deviate the detecting lever from a trajectory in which the cinching lever is pushed. In this case, due to a latch structure, the detecting lever falls inside the cinching lever, such that hit noise is generated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made to solve the above-mentioned problems occurring in the prior art while advantages achieved by the prior art are maintained intact.

Various aspects of the present invention provide for an interrupt structure of a power latch for improving interrupt durability of the power latch and decreasing noise generated at the time of an operation.

Various aspects of the present invention provide for an interrupt structure of a power latch, including: a cinching lever provided in the power latch and enabling automatic latching; a detecting lever having one end rotatably mounted at the cinching lever and the other end including an outer wall having gear teeth formed on an inner peripheral surface thereof; a gear part engaged with the gear teeth formed on the outer wall of the detecting lever; and a detecting auxiliary lever rotatably mounted at the other end of the detecting lever and having one end engaged with the gear part and the other end protruded outwardly.

The detecting lever may have a bent central portion.

The detecting auxiliary lever may include: an engagement part having gear teeth formed on an outer peripheral surface thereof to thereby be engaged with the gear part; and a protrusion provided at the other side of the engagement part and protruded outwardly of the detecting lever.

The cinching lever may include a bent part formed at a lower end portion thereof, wherein the bent part is spaced apart from the protrusion of the detecting auxiliary lever by a predetermined interval, such that it does not always contact the protrusion.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 6(*b*) is a view showing a state after the detecting lever avoidance section of the cinching lever is reinforced in the interrupt structure of the exemplary power latch according to the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An interrupt structure of a power latch according to an exemplary embodiment of the present invention is configured to include a cinching lever 100 provided in the power latch, a detecting lever 200 rotatably mounted at the cinching lever 100, a gear part 220 engaged with the detecting lever 200, and a detecting auxiliary lever 300 engaged with the gear part 220, as shown in FIGS. 2 to 6(*b*).

Figure 1:
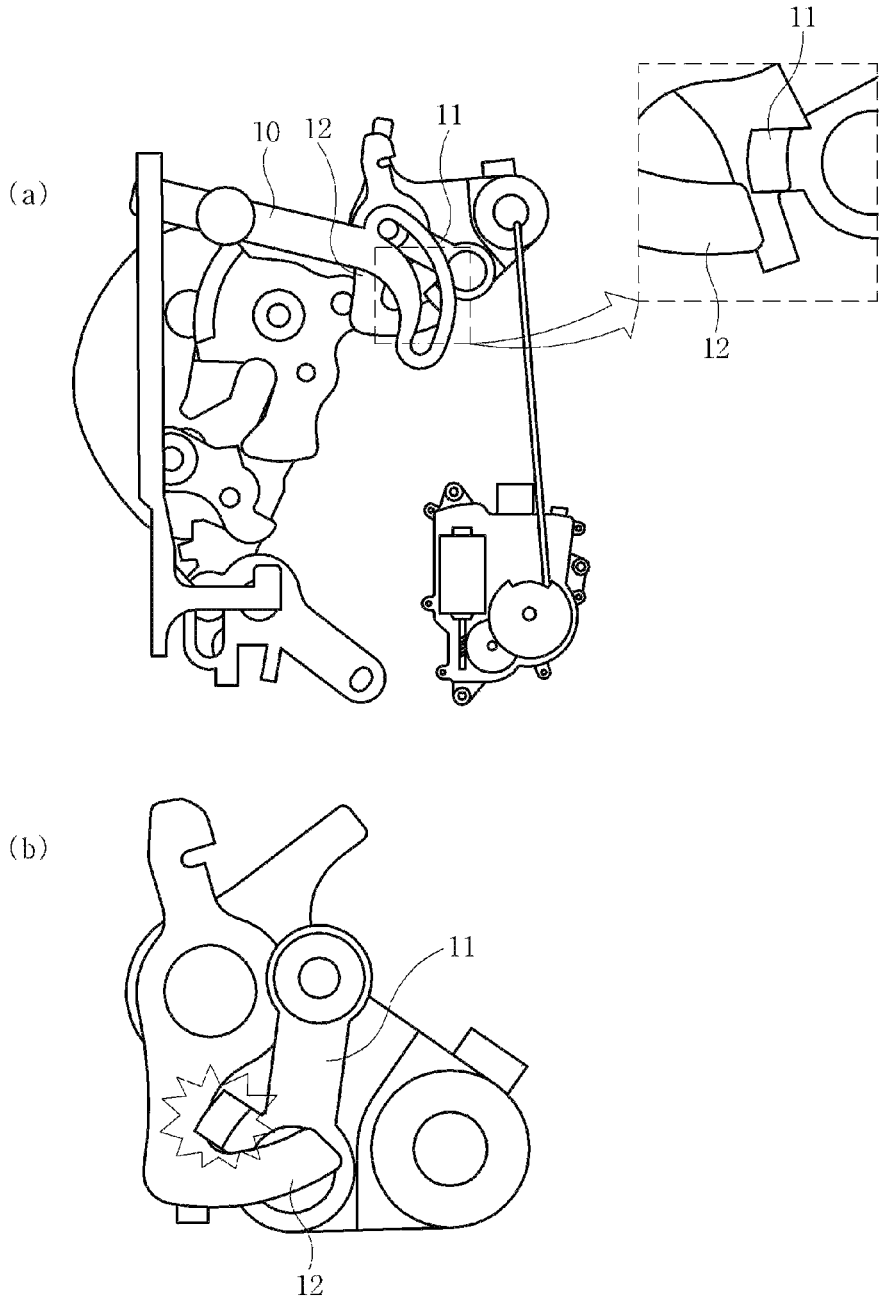
FIGS. 1(*a*) and 1(*b*) are views showing an interrupt structure of a power latch according to the related art.
Figure 2:
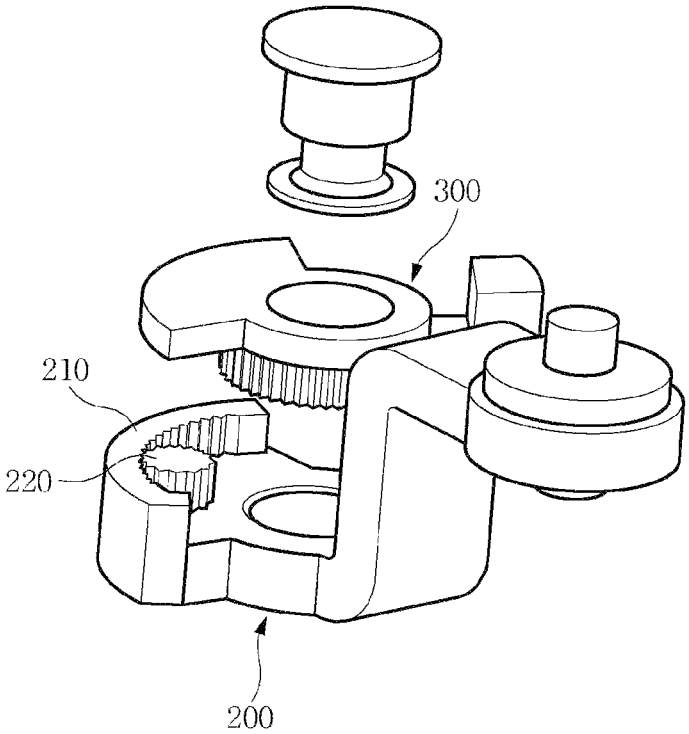
FIG. 2 is a view showing an interrupt structure of an exemplary power latch according to the present invention.
Figure 3:
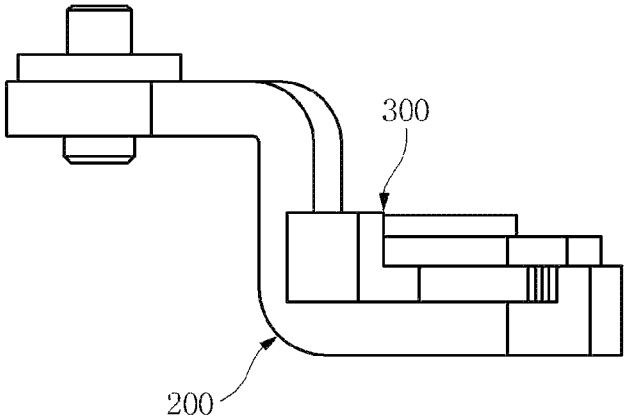
FIG. 3 is a side view showing the interrupt structure of the exemplary power latch according to the present invention.
Figure 4:
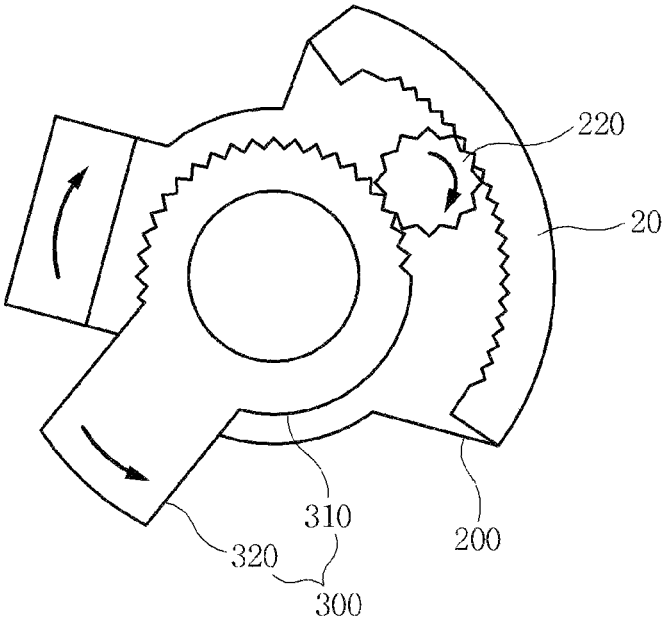
FIG. 4 is a view showing a state in which a detecting lever and a detecting auxiliary lever are coupled to each other in the interrupt structure of the exemplary power latch according to the present invention.
Figure 5:
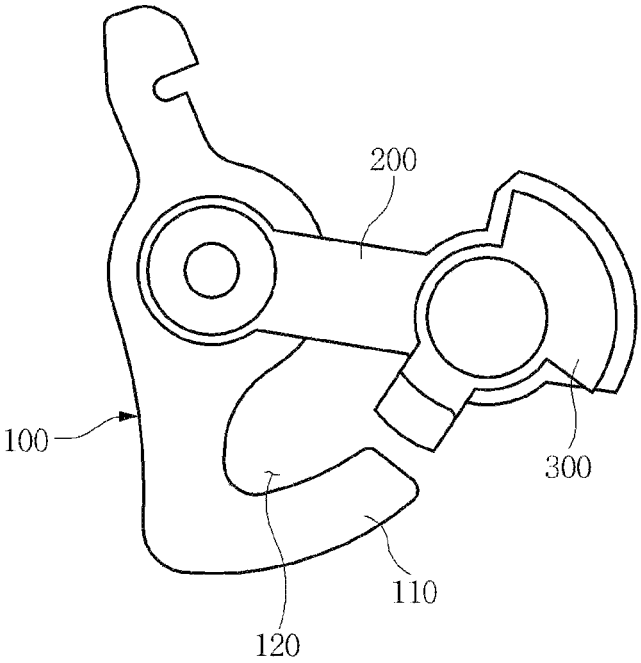
FIG. 5 is a plan view showing the interrupt structure of the exemplary power latch according to the present invention.
Figure 6:
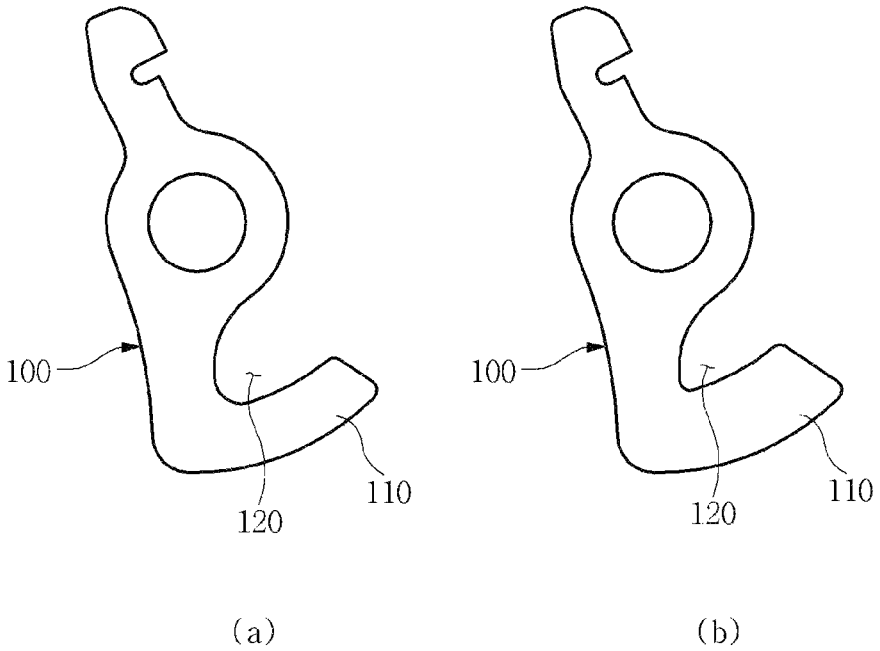
FIG. 6(*a*) is a view showing a state before a detecting lever avoidance section of a cinching lever is reinforced in the interrupt structure of the exemplary power latch according to the present invention.

As shown in FIGS. 2 and 3, the cinching lever 100 (See FIGS. 5 to 6(*b*)) is provided at a cancelling lever 10 (See FIGS. 1(*a*) and 1(*b*)) of the power latch to enable an automatic latching function. Since the automatic latching operation of the cinching lever has been well-known, a detailed description thereof will be omitted.

The detecting lever 200 has one end rotatably mounted at the cinching lever 100 and the other end at which an outer wall 210 is formed.

Here, the detecting lever 200 includes gear teeth formed on an inner peripheral surface of the outer wall 210 thereof.

In addition, a central portion of the detecting lever 200 may be bent, such that an upper end portion of the detecting lever 200 is mounted at the cinching lever 100 and a lower end portion thereof is connected to a detecting auxiliary lever 300 to be described below.

The gear part 220, which is a cylindrical gear having gear teeth formed on an outer peripheral surface thereof, is engaged with the gear teeth formed on the inner peripheral surface of the outer wall 210 of the detecting lever 220.

As shown in FIGS. 2 and 5, the detecting auxiliary lever 300 is rotatably mounted at the other end of the detecting lever 200 at which the outer wall 210 is formed.

Meanwhile, the detecting auxiliary lever 300 includes an engagement part 310 provided at one end thereof and a protrusion 320 provided at the other end thereof; wherein the engagement part 310 has gear teeth formed on an outer peripheral surface thereof to thereby be engaged with the gear part 220 and the protrusion 320 is provided at the other end of the engagement part 310 and outwardly of the detecting lever.

Here, the cinching lever 100 includes a bent part 110 formed at a lower end portion thereof; wherein the bent part 110 may be spaced apart from the protrusion 320 of the detecting auxiliary lever 300 by a predetermined interval, such that it does not always contact the protrusion 320 at the time of rotation of the detecting auxiliary lever 300.

Meanwhile, as shown in FIGS. 6(*a*) and 6(*b*), a detecting lever avoidance section 120 is formed in the cinching lever 110. According to the exemplary embodiment of the present invention, since the cinching lever 100 and the detecting auxiliary lever 300 do not contact each other, the detecting lever avoidance section 120 is not required. Therefore, the detecting lever avoidance section 120 is reinforced, such that rigidity thereof is improved, thereby making it possible to increase durability.

As a result, according to the exemplary embodiment of the present invention, when the cancelling lever 10 (See FIG. 1) is operated, the detecting auxiliary lever 300 of the detecting lever 200 connected to the cinching lever 100 is rotated. In this case, since the engagement part 310 formed at one end of the detecting auxiliary lever 300 is engaged with an inner side of the outer wall 210 of the detecting lever 200 through the gear part 220, the protrusion 320 formed at the other end of the detecting auxiliary lever 300 is rotated in an opposite direction to a direction in which the detecting lever 200 is rotated, such that it does not contact the bent part 110 of the cinching lever 100.

As described above, according to the exemplary embodiment of the present invention, since the detecting auxiliary lever 300 is rotated in an opposite direction to a rotation direction according to the related art, generation of hit noise due to an interference with the cinching lever 100 is prevented, thereby making it possible to increase marketability. In addition, since interference is not generated at the time of an interrupt, the detecting lever avoidance section 120 of the cinching lever 100 may be reinforced, such that rigidity thereof is improved, thereby making it possible to improve durability.

As set forth above, according to the exemplary embodiment of the present invention, the detecting lever is operated in an opposite direction to an operation direction according to the related art to prevent generation of interference with the cinching lever, thereby making it possible to decrease noise. In addition, rigidity of a detecting lever avoidance section formed at the cinching lever is reinforced, thereby making it possible to improve durability.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An interrupt structure of a power latch configured to cancel an automatic latching function of the power latch when a handle is operated to open a door during the automatic latching function, comprising:

a cinching lever provided in the power latch and enabling automatic latching;

a detecting lever having a first end rotatably mounted to the cinching lever and a second end including an outer wall having gear teeth formed on an inner peripheral surface thereof;

a gear engaged with the gear teeth formed on the outer wall of the detecting lever; and a detecting auxiliary lever rotatably mounted on the second end of the detecting lever and having a first end engaged with the gear and a second end protruding outwardly from the second end of the detecting lever;

whereby the second end of the detecting auxiliary lever rotates opposite to the detecting lever thereby preventing contact between the second end of the detecting auxiliary lever and the cinching lever.

2. The interrupt structure according to claim 1, wherein the detecting lever has a bent central portion.

3. The interrupt structure according to claim 1, wherein the detecting auxiliary lever includes:

an engagement part having gear teeth formed on an outer peripheral surface thereof to thereby be engaged with the gear; and a protrusion provided at the second end of the detecting auxiliary lever and protruding outwardly of the detecting lever.

4. The interrupt structure according to claim 3, wherein the cinching lever includes a bent part formed at a lower end portion thereof, the bent part being spaced apart from the protrusion of the detecting auxiliary lever by a predetermined interval, such that it does not always contact the protrusion.

* * * * *